US008821600B2

(12) United States Patent
Darby et al.

(10) Patent No.: US 8,821,600 B2
(45) Date of Patent: Sep. 2, 2014

(54) DRY BOTTOM REACTOR VESSEL AND METHOD

(75) Inventors: Alan Darby, West Hills, CA (US); Steven P. Fusselman, Simi Valley, CA (US)

(73) Assignee: Aerojet Rocketdyne of DE, Inc.

( * ) Notice: Subject to any disclaimer, the term of this patent is extended or adjusted under 35 U.S.C. 154(b) by 274 days.

(21) Appl. No.: 13/307,152

(22) Filed: Nov. 30, 2011

(65) Prior Publication Data

US 2013/0134358 A1 May 30, 2013

(51) Int. Cl.
*C01B 6/24* (2006.01)
*C10J 3/86* (2006.01)

(52) U.S. Cl.
USPC ..... 48/61; 48/197 R; 423/644; 423/648.1

(58) Field of Classification Search
CPC ..... C10J 3/86; C10J 3/34; C10J 3/46; C10J 3/485
USPC ..... 48/61
See application file for complete search history.

(56) References Cited

U.S. PATENT DOCUMENTS

| | | | | |
|---|---|---|---|---|
| 2,961,310 | A | 11/1960 | Steever | |
| 3,088,816 | A | 5/1963 | Huntington | |
| 4,278,446 | A | 7/1981 | Von Rosenberg, Jr. et al. | |
| 4,368,103 | A * | 1/1983 | Weinzierl et al. | 202/99 |
| 4,400,181 | A | 8/1983 | Snell et al. | |
| 4,643,109 | A | 2/1987 | Meyer | |
| 6,214,065 | B1 * | 4/2001 | Berg | 48/197 R |
| 2008/0011247 | A1 * | 1/2008 | Alexander | 122/7 D |
| 2008/0134581 | A1 | 6/2008 | Van Dyk et al. | |
| 2009/0029299 | A1 | 1/2009 | Fischer et al. | |
| 2011/0120013 | A1 | 5/2011 | Van Dyk et al. | |

FOREIGN PATENT DOCUMENTS

| | | |
|---|---|---|
| DE | 102008035295 | 2/2010 |
| EP | 0227197 | 7/1987 |
| WO | 2006082543 | 8/2006 |

OTHER PUBLICATIONS

International Search Report for PCT Application No. PCT/US2012/066773 completed on Mar. 13, 2013.

* cited by examiner

*Primary Examiner* — Matthew Merkling
(74) *Attorney, Agent, or Firm* — Joel G Landau

(57) ABSTRACT

A reactor vessel includes an entrained-flow gasifier and a dry solids discharge beneath the gasifier.

20 Claims, 4 Drawing Sheets

DRY BOTTOM REACTOR VESSEL AND METHOD

BACKGROUND

This disclosure relates to reactor vessels and, more particularly, to dry bottom reactors.

In reactor vessels, such as those used in coal gasification systems to produce synthesis gas or "syngas," the reaction products are quench-cooled with water before subsequent downstream processing. Excess quench water falls to the bottom of the reactor vessel and forms a slurry that it is then collected and filtered to remove slag and byproduct material. The filtered waste water stream, or "black" water, still includes at least trace amounts of slag and byproduct.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
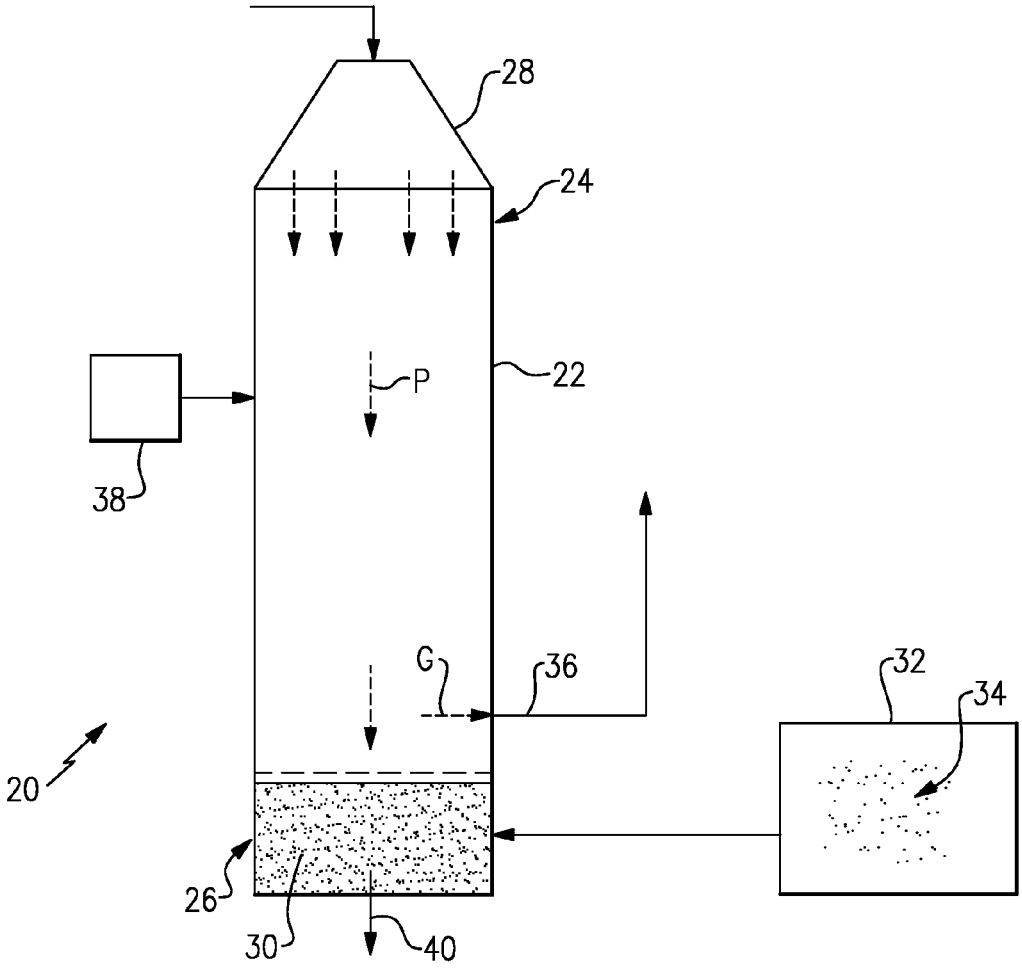
FIG. 1 shows an example of a dry bottom reactor vessel.

FIG. 1 illustrates selected portions of an example dry bottom reactor vessel 20. In this example, the reactor vessel 20 is adapted for coal gasification to produce syngas. It is to be understood, however, that this disclosure is also applicable to other types of reactor vessels and is not limited to coal gasification. As will be described below, the dry bottom reactor vessel 20 utilizes a dry solids material as a receiving bed for any hot slag that drops to the bottom of the reactor vessel. The receiving bed protects the reactor vessel from contact with the hot slag and thereby reduces the need for full water quenching.

The reactor vessel 20 includes an entrained-flow gasifier 22 that is generally a hollow vessel that extends between a top portion 24 and a bottom portion 26. A feed stock injector 28 is arranged at the top portion 24 to receive and inject the reactants into the interior volume of the entrained-flow gasifier 22. As an example, the feed stock injector 28 can include an impingement-style jet injector. Given this description, one of ordinary skill in the art will recognize other suitable types of injectors to meet their particular needs.

A dry bed zone 30 is located opposite the feed stock injector 28 at the bottom portion 26 of the entrained-flow gasifier 22. A dry bed source 32 is connected to the entrained-flow gasifier 22 and arranged to convey a dry solids material 34 to the dry bed zone 30 at the bottom portion 26 of the entrained-flow gasifier 22. In embodiments, the dry solids material 34 feeds gravimetrically and/or with mechanical assistance.

In one example, the dry solids material 34 comprises a byproduct from the reaction that occurs in the entrained-flow gasifier 22, such as dry coal ash. The term "dry" as used in this disclosure refers to the substantial absence of liquid water. For instance, the dry solids material 34 may include moisture or a limited amount of liquid water, but does not include enough liquid water to form a suspension of the solids material. In further examples, the dry solids material 34 includes substantially no liquid water.

As also shown, the reactor vessel 20 in this example includes a discharge line 36 arranged to receive a byproduct gas stream G from the entrained-flow gasifier 22, and a quench device 38 located closer to the top portion 24 for partially quenching a product stream P to a temperature lower than the "sticking" temperature of the slag in the product stream P. The "sticking" temperature can be determined experimentally from the given reactants, and is the temperature at which the slag does not adhere to the walls of the entrained-flow gasifier 22.

In operation, reactant feed materials are provided to the feed stock injector 28 and injected into the entrained-flow gasifier 22 for reaction. The quench device 38 partially quenches the product stream P with water to reduce the temperature of the product stream P. In one example, the partial quench does not saturate the product stream P to produce liquid water that drops to the bottom of the entrained-flow gasifier 22. Thus, the quench water vaporizes into steam instead of forming liquid droplets that drop down.

The gas stream G portion and any entrained solid particulate matter exits from the entrained-flow gasifier 22 through the discharge line 36. Any solids that are too heavy to be entrained within the gas stream G, such as hot slag, fall to the bottom of the entrained-flow gasifier 22 and into the dry bed zone 30. The dry bed source 32 provides the dry solids material 34 into the dry bed zone 30. The dry solids material 34 serves as a receiving bed for the hot slag and any other solids that drop. The dry solids material 34 serves to cool the hot slag and prevent or limit contact between the hot slag and the walls or liner of the entrained-flow gasifier 22, which could otherwise damage the entrained-flow gasifier 22.

The slag and solids that fall into the dry solids material 34 in the dry bed zone 30 are later removed through a discharge 40 beneath the entrained-flow gasifier 22. The slag and dry bed material 34 may be recycled and either re-injected into the feed stock injector 28 and/or reintroduced into the dry bed source 32. Thus, the use of the dry bed zone 30 and the dry solids material 34 to receive and cool the hot slag reduces the need to quench-cool the product stream P with water, which eliminates the waste "black" water stream that is generated in a full water quench system.

Figure 2:
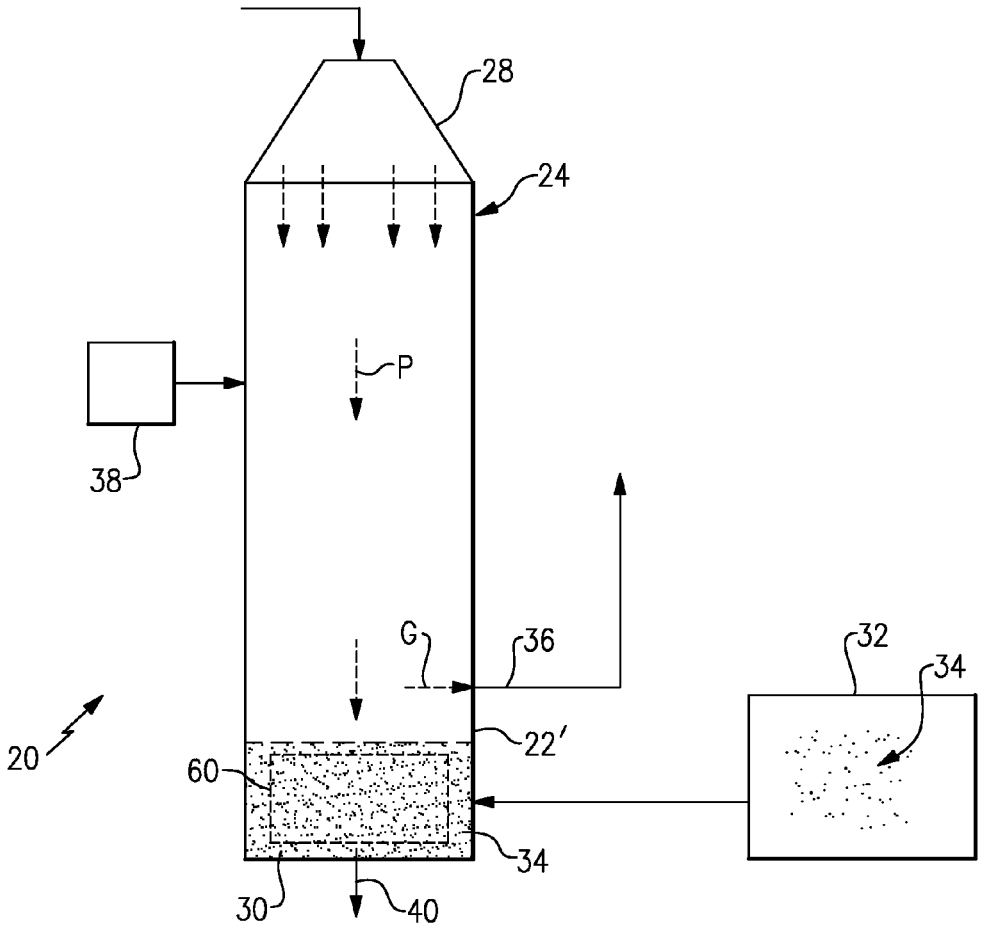
FIG. 2 shows an example of a dry bottom reactor vessel with a cooler located in a dry bed zone.

FIG. 2 illustrates a modified embodiment of the entrained-flow gasifier 22' that includes a cooler 60 within the dry bed zone 30. In this disclosure, like reference numerals designate like elements where appropriate and reference numerals with the addition of a prime ('), one-hundred or multiples thereof designate modified elements that are understood to incorporate the same features and benefits as the corresponding elements. In one example, the cooler 60 is a heat exchanger in which a relatively cool working fluid circulates. The cooler 60 is partially or fully embedded within the dry solids material 34. The cooler 60 serves to cool the hot slag and dry bed zone 30 and further prevent or limit damage to the entrained-flow gasifier 22'.

Figure 3:
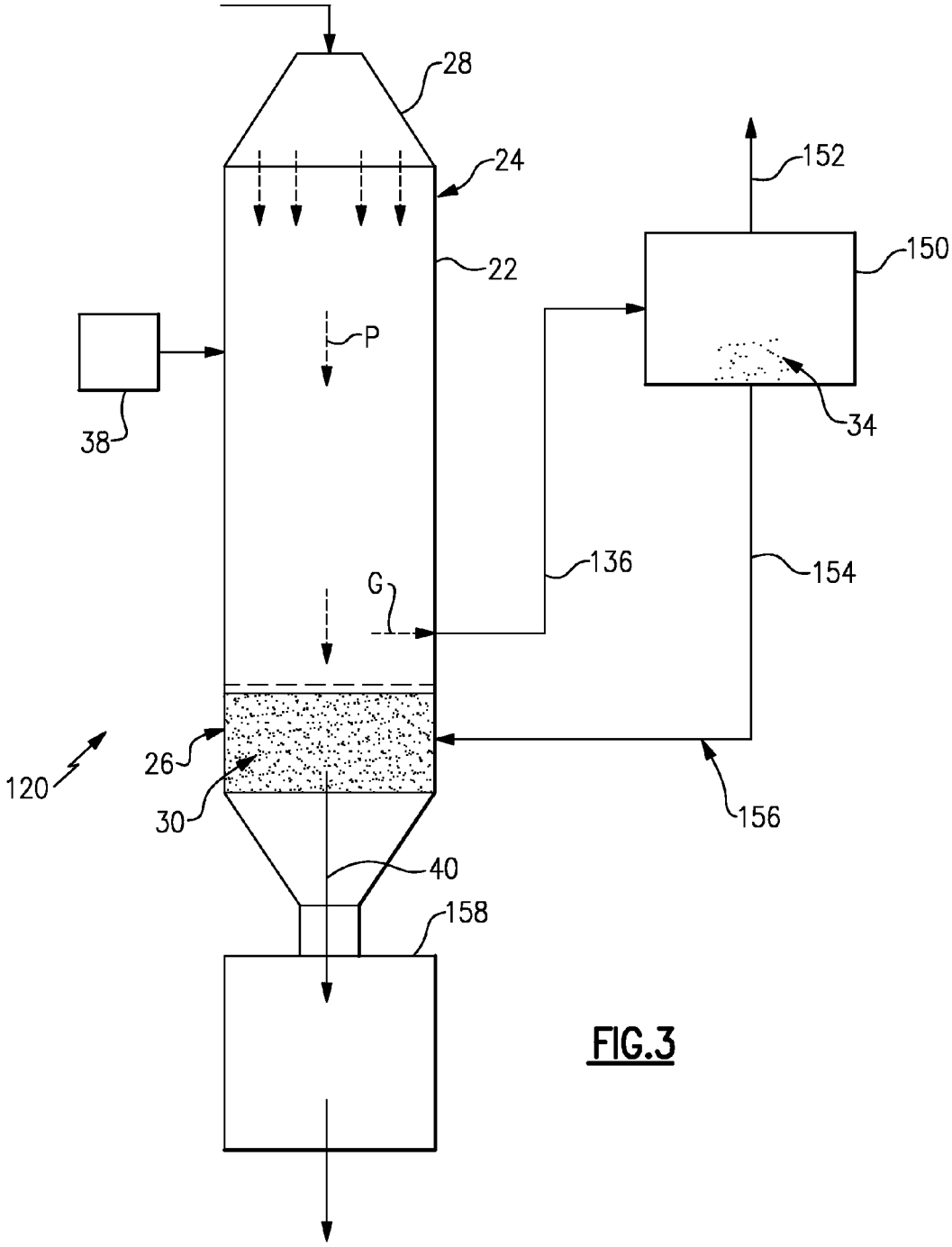
FIG. 3 shows another example of a dry bottom reactor vessel.

FIG. 3 illustrates another embodiment of a reactor vessel 120. In this example, the gas stream G is discharged from the entrained-flow gasifier 22 through a discharge line 136 that is connected to a particle separator 150. In embodiments, the particle separator 150 includes a cyclone separator, a filter, such as a candle filter, or both. The particle separator 150 is operable to divide the byproduct gas stream G into a clean stream 152 (e.g., with a lower concentration of particulate) and a separated dry solids stream 154. For example, the separated dry solids stream 154 includes fly ash/slag and/or other solid particulate matter that was entrained in the gas stream G. The separated ash and solid particulate matter is then used as the dry solids material 34 and returned through return line 156 to the dry bed zone 30 of the entrained-flow gasifier 22. Thus, the particle separator 150 in this example is the dry bed source. Optionally, the cooler 60 is provided within the dry bed zone 30, as described above.

As shown, the particle separator 150 is located above the dry bed zone 30. In a further example, the separated dry solids stream 154 gravimetrically feeds to the dry bed zone 30. In additional examples, a pump of blower is additionally provided to assist the gravimetric feed.

As also shown in FIG. 3, the dry solids material 34 and any hot slag or other solids that fall to the bottom of the entrained-flow gasifier 22 are collected beneath the entrained-flow gasifier 22 in a discharge, a lock hopper 158, before further processing to recycle the byproduct solids. A crusher or other suitable mechanical device may be used within the dry bed zone 30 to break up the solids into smaller particulates that gravimetrically fall through an outlet at the bottom of the entrained-flow gasifier 22 and are collected in the lock hopper 158.

Figure 4:
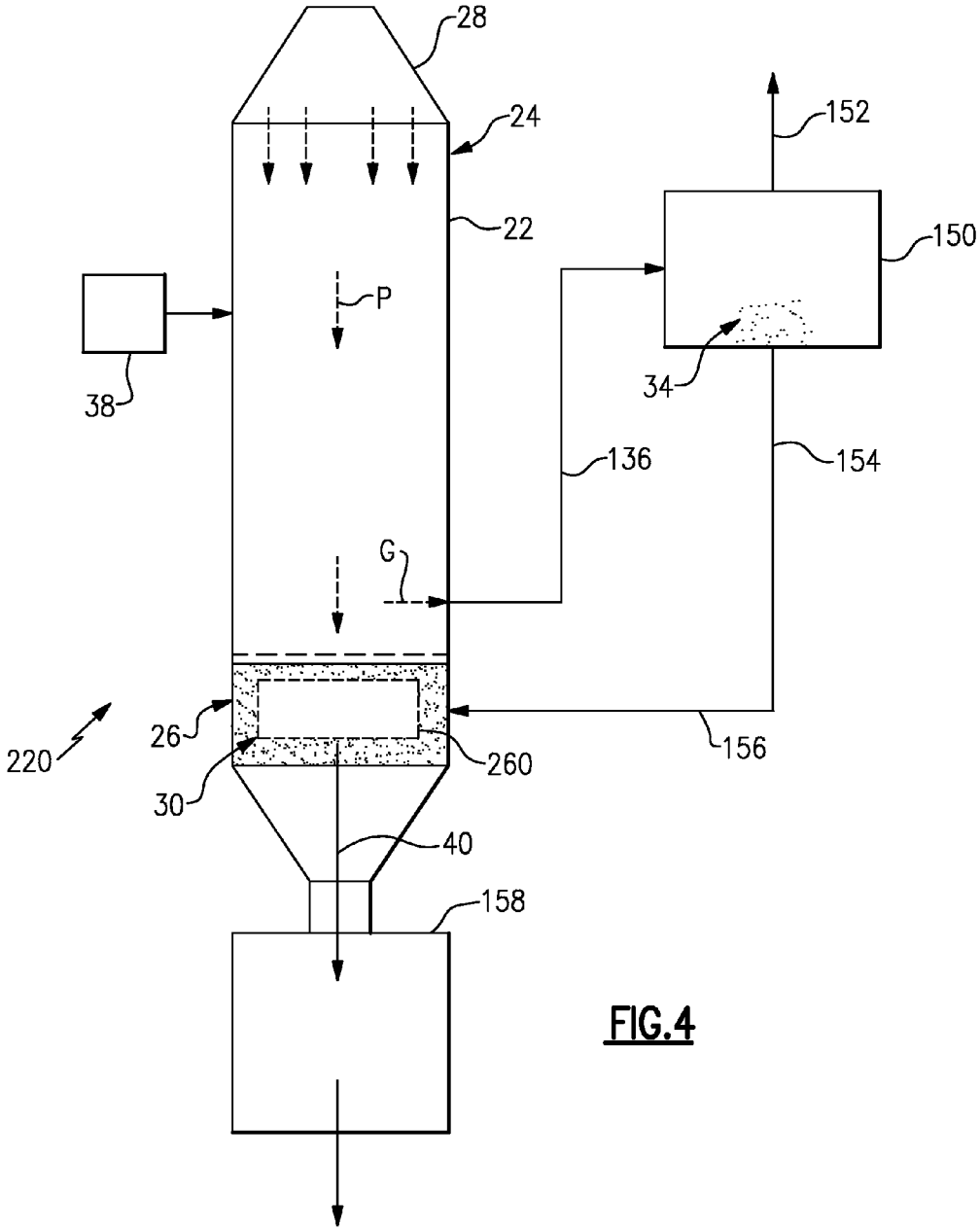
FIG. 4 shows a third example of a dry bottom reactor vessel.

FIG. 4 shows another embodiment of a reactor vessel 220 that is similar to the reactor vessel 120 shown in FIG. 2. In this example, a cooler 260 is located within the dry bed zone 30 to remove excess heat from the accumulating solids bed. The cooler device 260 serves to cool the dry bed zone 30 to avoid over-heating the entrained-flow gasifier 22 and also help cool the hot slag or other solids that fall into the dry bed zone 30.

In one example, the cooler device 260 includes a heat exchanger that utilizes a relatively cool working fluid to reduce the temperature of the dry bed zone 30. In another example, the cooler device 260 includes a water quench. The water quench operates to partially quench the separated dry solids stream 154 such that the quench water vaporizes to steam rather than forming a substantial amount of liquid water. In another example, the cooler device 260 includes a gas quench. The gas quench injects a relatively cool gas into the separated dry solids stream 154 to cool the stream. It is to be understood that cooler device 260 is not limited to the above examples and that, given this description, one of ordinary skill in the art will be able to recognize other cooling devices to meet their particular needs.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A reactor vessel comprising:

an entrained flow gasifier comprising a top portion and a bottom portion, with a feed stock injector at the top portion;

the bottom portion including a dry bed zone having dry solids material that is situated to initially catch falling slag in the entrained flow gasifier;

a cooler device to remove heat from the dry bed zone at the bottom portion;

a dry solids discharge beneath the dry bed zone;

a particle separator operable to produce a clean stream and a separated dry solids stream;

a discharge line connected between the entrained-flow gasifier and the particle separator, the discharge line arranged to receive a product stream from the entrained-flow gasifier and convey the product stream to the particle separator; and a return line connected between the particle separator and the entrained-flow gasifier, the return line arranged to receive the separated dry solids stream from the particle separator and convey the separated dry solids stream to the dry bed zone at the bottom portion of the entrained-flow gasifier.

2. The reactor vessel as recited in claim 1, wherein the cooler device includes a heat exchanger.

3. The reactor vessel as recited in claim 1, wherein the cooler device achieves the cooling of the solids in the dry bed zone primarily by evaporation of liquid water in proximity to or contact with the solids in the dry bed zone.

4. The reactor vessel as recited in claim 1, wherein the cooler device achieves the cooling of the solids in the dry bed zone primarily by heat transfer to a gas passing through the dry bed zone.

5. The reactor vessel as recited in claim 1, wherein the particle separator is a cyclone separator.

6. The reactor vessel as recited in claim 1, wherein the particle separator is a filter.

7. The reactor vessel as recited in claim 1, wherein the cooler device includes a heat exchanger.

8. The reactor vessel as recited in claim 1, wherein the cooler device includes a water quench.

9. The reactor vessel as recited in claim 1, wherein the cooler device includes a gas quench.

10. A reactor vessel comprising:

an entrained-flow gasifier including a top portion and a bottom portion, with a feed stock injector at the top portion and a dry bed zone at the bottom portion; and a dry bed source including dry solids material, the dry bed source being connected to the entrained-flow gasifier and arranged to convey the dry solids material to the dry bed zone at the bottom portion of the an entrained-flow gasifier;

a cooler device to remove heat from the dry bed zone at the bottom portion;

a discharge line connected between the entrained-flow gasifier and the dry bed source, the discharge line arranged to receive a product stream from the entrained-flow gasifier and convey the product stream to the dry bed source; and a return line connected between the dry bed source and the entrained-flow gasifier, the return line arranged to receive a separated dry solids stream from the dry bed source and convey the separated dry solids stream to the dry bed zone at the bottom portion of the entrained-flow gasifier.

11. The reactor vessel as recited in claim 10, wherein the dry solids material comprises coal ash or slag.

12. The reactor vessel as recited in claim 10, wherein the dry bed source comprises a particle separator.

13. The reactor vessel as recited in claim 12, wherein the particle separator is selected from a group consisting of a cyclone separator, a filter and combinations thereof.

14. The reactor vessel as recited in claim 12, wherein the particle separator comprises a candle filter.

15. The reactor vessel as recited in claim 1, further comprising a quench device situated to introduce water into a product stream within the entrained-flow gasifier, above the dry bed zone.

16. The reactor vessel as recited in claim 1, further comprising a quench device situated to introduce water into a downwardly-flowing product stream within the entrained-flow gasifier, above the dry bed zone.

17. The reactor vessel as recited in claim 1, wherein the cooler is at least partially embedded in the dry solids material.

18. The reactor vessel as recited in claim 10, wherein the dry solids material is situated to initially catch falling slag in the entrained-flow gasifier.

19. The reactor vessel as recited in claim 1, wherein the dry bed zone is located at an opposite end of the entrained-flow gasifier from a reactant feed stock injector.

20. The reactor vessel as recited in claim 10, wherein the dry bed zone is located at an opposite end of the entrained-flow gasifier from a reactant feed stock injector.

* * * * *